United States Patent [19]

Walck

[11] 4,390,995

[45] Jul. 5, 1983

[54] SHOCK DAMPING FACE GUARD STRAP FOR FOOTBALL HELMETS

[76] Inventor: Vernon R. Walck, 267 Bonita Dr., Bakersfield, Calif. 93305

[21] Appl. No.: 354,169

[22] Filed: Mar. 3, 1982

[51] Int. Cl.[3] ..... A41D 13/00; A42B 3/00

[52] U.S. Cl. ..... 2/9

[58] Field of Search ..... 2/9, 10, 424, 411

[56] References Cited

U.S. PATENT DOCUMENTS

| | | | |
|---|---|---|---|
| 2,785,405 | 3/1957 | Snyder | 2/9 |
| 3,787,895 | 1/1974 | Belvedere | 2/9 |
| 4,086,664 | 5/1978 | Humphrey et al. | 2/9 |

*Primary Examiner*—Peter P. Nerbun

*Attorney, Agent, or Firm*—William H. Maxwell

[57] ABSTRACT

Shock damping anchor straps for a face guard mounted on a transverse axis to the brow portion of a football helmet, the face guard having an anchor bar at each side ear portion of the helmet, there being a flexible anchor strap at each anchor bar and each strap having an inner loop passing through the ear hole and around the front edge of the ear portion of the helmet and the ends thereof secured by holes therethrough engaged over a tubular nut, and having an outer loop continuing from the inner loop and wrapped over the anchor bar and the end thereof secured over a compressible shock damping washer by a hole therethrough and held engaged over said tubular nut by a screw threadedly engaged therein.

13 Claims, 6 Drawing Figures

SHOCK DAMPING FACE GUARD STRAP FOR FOOTBALL HELMETS

BACKGROUND

This invention relates to football helmets and especially to the face guards thereof which must be securely but yieldably fastened to the helmet. That is, the face mask must be shock mounted so as to move relative to the helmet upon any severe impact, and such that it returns to its original installed position intact with the helmet. The helmet is a tough shell with internal padding fitted over the football player's head and ears, and with a face opening defined by the lower edge of a brow portion above the eyes of the player, and by the forward edges of ear portions at opposite sides of the helmet. The face guard is a grid of bar elements that cross and are interconnected so as to be integral and meet the requirements of the individual player. There are many individual styles of such face guards, it being a general object of this invention to provide a shock absorbing anchor strap that reliably secures the face guard to the helmet at the ear portions thereof and an anchor strap that is easily cut loose as circumstances may require.

Characteristically, the face guards have a transverse mounting bar fixed to the brow portion of the helmet to rotate on a transverse horizontally disposed axis, whereby the face guard inherently swings until secured to the sides of the helmet in spaced relation to the said rotational axis. Anchor bars are angularly disposed at the sides of the face guard so as to transfer tangential forces through a strap-like fitting and into the ear portion of the helmet. The natural disposition of the face opening edges at said ear portions is vertical, in which case it is only natural and expedient that the face guard have complementary vertically disposed anchor bars at opposite sides thereof. Force application at the anchor strap is tangential to a radial line drawn from the axis of rotation at the mounting bar. Accordingly, it is an object of this invention to provide an anchor strap for use with face guards having side anchor bars and such that impact forces are absorbed tangentially from the mounting axis and into the ear portions of the helmet.

A typical face guard for football helmets has at least two chin bars that embrace the lower face of the player, and these are upper and lower bars, and often an intermediate bar is disposed therebetween, crossed and connected to the vertical anchor bars and also to the side extensions of the mounting bar. In this manner, openings are formed to receive the anchor straps at a substantial radius from the mounting axis, and all of which is laterally displaced and out of line from the player's vision. Thus, a player's vision is not impaired by the anchor bars complementary to the vertical edges of the helmet ear portions to which the otherwise rotatable face guard is to be anchored. Overlying each ear portion of the helmet the crossed bar members of the face guard form anchor openings through which the anchor straps can be laced to pull the face guard into position on the helmet, and against one of said bars (at each side) there is a buffer means and fastener means that have cushioned engagement adapted to absorb shock. It is an object of this invention to provide an anchor strap and buffer means therefor which has a shock damping action in both tension and compression modes, and which is also flexible so as to compensate for misalignments.

Prior art football helmets have been fitted with face guards through the application thereto of intermediate block-like fittings of yieldable semi-hard plastic referred to generally as straps, for their split or wrap-around configuration that embraces the anchor bar of the face guard. It has been common practice to attach these blocks or straps to the helmets by means of a screw fastener passing therethrough and also through the helmet in each instance. The hole necessary for this attachment weakens the helmet by creating break points that start fractures and/or separations. This weakened condition is then worsened when a face guard of different configuration is applied to a helmet which requires drilling of new holes, and accordingly there are restrictions as to how close adjacent holes may be placed, for example not closer than 0.5 inch, which is often impossible. Consequently, otherwise good helmets are discarded when there are too many holes therethrough, when a new face guard cannot be properly installed within the minimum hole space requirement, and very often because the helmet has become weakened and damaged or cracked so as to be dangerous. Therefore, it is an object of this invention to provide an anchor strap and buffer means for installation of face on protective helmets without penetration of the helmet, thereby eliminating any fastener holes that heretofore have weakened said helmets.

SUMMARY OF INVENTION

This invention provides an anchor strap shock damper adapted to connect the anchor bar openings of face guards to football helmets. The protective face guard is mounted in the usual manner on a transverse horizontal axis above the brow opening in the helmet, and the face guard affords clear vision by means of placing the anchor bar openings closely adjacent to and complementary to the face opening side edges of the ear portions of the helmet. The anchor strap shock damper of the present invention is a strong and flexible elongated member trained over and through the anchor bar opening and ear portion of the helmet to which it is attached. The tightness and disposition of the strap is such that forces applied tangentially from the mounting axis of the face guard are by an elastic action, thereby absorbing shock and arresting impact forces.

The foregoing and various other objects and features of this invention will be apparent and fully understood from the following detailed description of the typical preferred form and application thereof, throughout which description reference is made to the accompanying drawings.

PREFERRED EMBODIMENT

Figure 1:
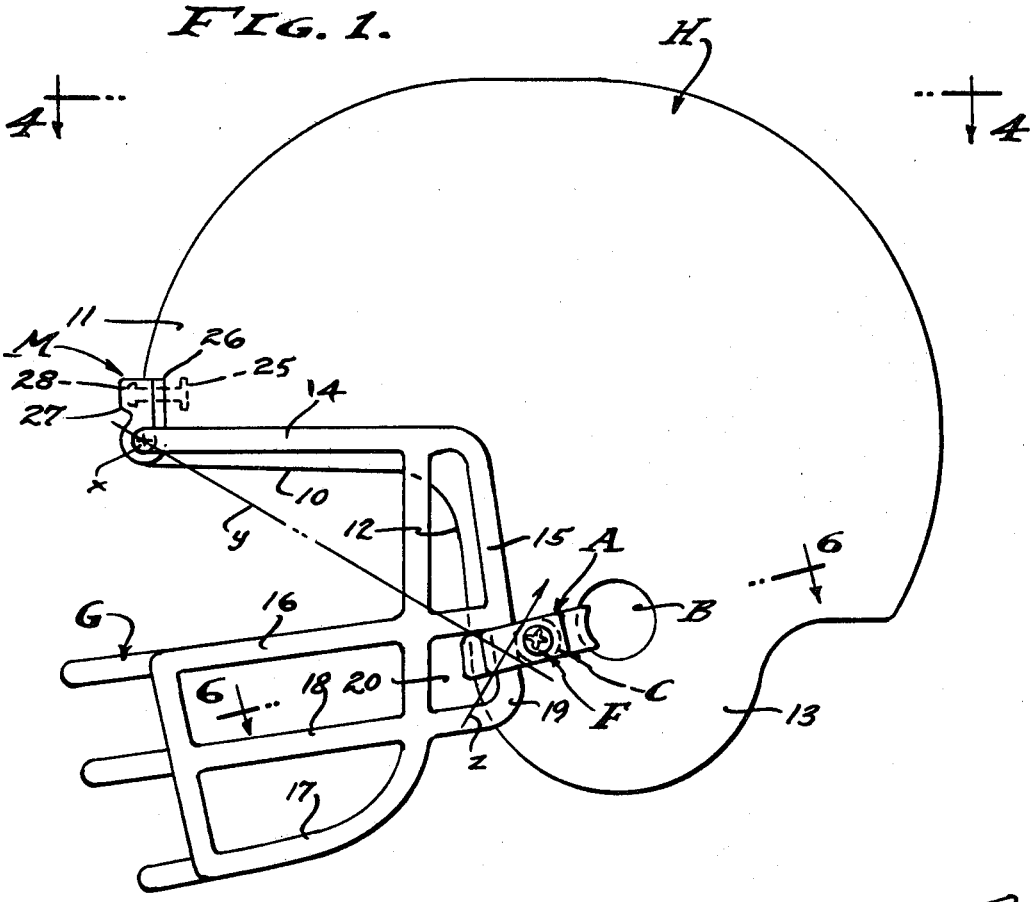
FIG. 1 is a side elevational view showing a helmet and face guard secured thereto by the anchor strap and shock damper of the present invention.

Referring now to the drawings, the helmet H is a tough shell that covers the head of a person, and of special concern to those persons who are football players and the like. In practice, the helmet is lined with thick padding (not shown) and is characterized by a face opening defined by the lower edge 10 of a brow portion 11, and by the spaced forward edges 12 of ear portions 13 at opposite sides of the helmet. The edge 10 is horizontally disposed above the line of upward vision and the edges 12 are vertically disposed at or behind the lines of peripheral vision. The ear portion edges 12 depend from the brow portion 11 at radiused corners, and the bottom edges of the ear portions are generously rounded. An open ear hole B is centered in each of said ear portions.

The face guard G is a framework of rods or tubes connected together as shown by means of welding, to form a grid that protects the face of the player. The said grid is spaced forwardly from the face and is comprised of concaved rods coated with a thick cover of soft plastic material. In practice, the face guard G is fastened to the exterior of the helmet H by means of a mounting bar 14 at the brow portion 11 of the helmet, and by spaced anchor bars 15 at the opposite side ear portions 13. The protective grid is comprised of at least one and preferably two or more face bars 16 and 17 (upper and lower) integral with the mounting bar 14 and anchor bar 15.

A typical face guard configuration is shown, wherein the mounting bar 14 is horizontally disposed and complementary to the brow portion edge 10, and wherein the anchor bars 15 are substantially vertical and complementary to the ear portion edges 12 at opposite sides of the helmet. As shown, the lower face bar 17 crosses the upper face bar 16 and parallels the anchor bar 15 to connect with the mounting bar at the plane of the face opening edge 10, and an intermediate face bar 18 parallels the plane of the upper face bar 16 (also the front plane of the lower face bar 17) and continues into the anchor bar 15 through a radius turn 19. It is this radius turn 19 and the parallel anchor bar 15 and vertical extension of the lower face bar 17 that form anchor openings 20 in the face guard G, spaced radially from the transverse and horizontally disposed mounting bar 14. In the drawings, the mounting axis is designated x, the radial line to opening 20 is designated y, and there is a tangent force line z at the anchor bar connection as will be described.

A feature of face guards of the type under consideration is that they are free to move with limited rotation about the mounting axis x. There is a dual purpose in this rotative movement; first to provide for flexibility in the attachment of the face guard G to the helmet H; and second to provide for swingability for exposure to the player's face in the event that access thereto is required without removing the helmet. As will be described, the anchor A of the present invention is pliable for flexibility and is severable for swingability. The mounting axis x is established by a pair of spaced mounting straps M, one at each side of the brow portion 11. As shown in plan view, the face guard bars 14–18 are rearwardly concave, the mounting bar 14 being an arcuate member passing through the pair of mounting straps M, to rotate on the transverse axis x coincidental therewith. In practice, a flanged nut 25 projects through the helmet shell immediately above the edge 10 of the face opening, and the strap has an inner leg 26 with an opening therethrough engaged over the nut, and has an outer leg 27 continuing therefrom and around the mounting bar and with an opening therethrough also engaged over the nut. Leg 27 overlies leg 26 at said nut, in each instance, and with a screw fastener 28 recessed therein for protection. The mounting strap M is made of a tough and pliable plastic such as Teflon or Nylon and is yielding to thereby afford substantial flexibility to said mounting at axis x.

In accordance with this invention I provide the anchor strap A and shock damper C by which the face guard G is securely yet yieldingly attached to the ear portion 13, at each side of the helmet H. The anchor strap A and shock damper C are cooperatively related to provide for coupled engagement between the anchor bar 15 and the outer side of the ear portion 13, in each instance, the anchor strap A being comprised of an elongated flexible body 30 of pliable material having inner and outer loops 31 and 32 that engage through the ear portion 13 of the helmet H and through the face guard G respectively, and the shock damper C being comprised of a flexible block or washer 33 of compressible material that reinforces the outer loop 32 and carries the fastener means F that secures the opposite ends of the anchor strap to form said loops. A feature of this invention is the yielding character of both the anchor strap A and the shock damper C, both made of a tough and flexible elastic material having limited stretch and good memory. Teflon or Nylon can be used, however a preferred material is clear polyurethane, a plastic of great strength that is readily formed by injection molding, that is flexible for reshaping, and that is adapted to be easily cut through in the event of an emergency requiring swinging of the face guard G relative to the helmet H.

Referring now to the mounting axis x as it is related to the tangent force line z, there is an angular relationship with the anchor bar 15 as the base of a right triangle right angularly disposed to the mounting bar 14 as the altitude, and with the radial line y extending therebetween as the hypotenuse. Accordingly, the face guard G is swingable on said axis x and the intersection of the base and of the hypotenuse rotates on a tangent normal to the radial line y. However, the mounting straps M are flexible so that impact forces directly at the face of the guard G drive it directly rearward, in which case a composite of forces is the result, and all of which is subject to twisting and wrenching of the face guard G relative to the helmet H. In actual practice, impact forces and motion to be damped are indescriminately applied and entirely unpredictable, and therefore a tight but yielding attachment is much to be desired and is provided as will now be described.

Figure 2:
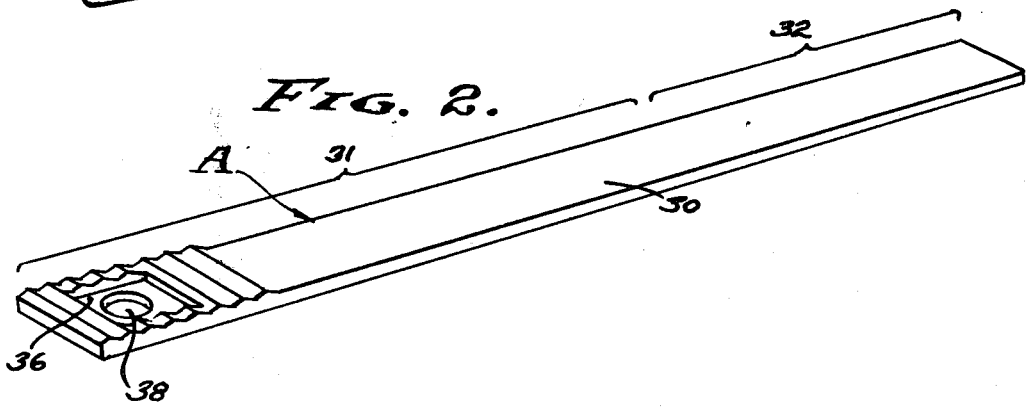
FIG. 2 is a perspective view of the anchor strap as it is initially formed.
Figure 3:
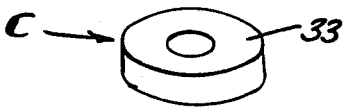
FIG. 3 is a perspective view of the shock damper.
Figure 4:
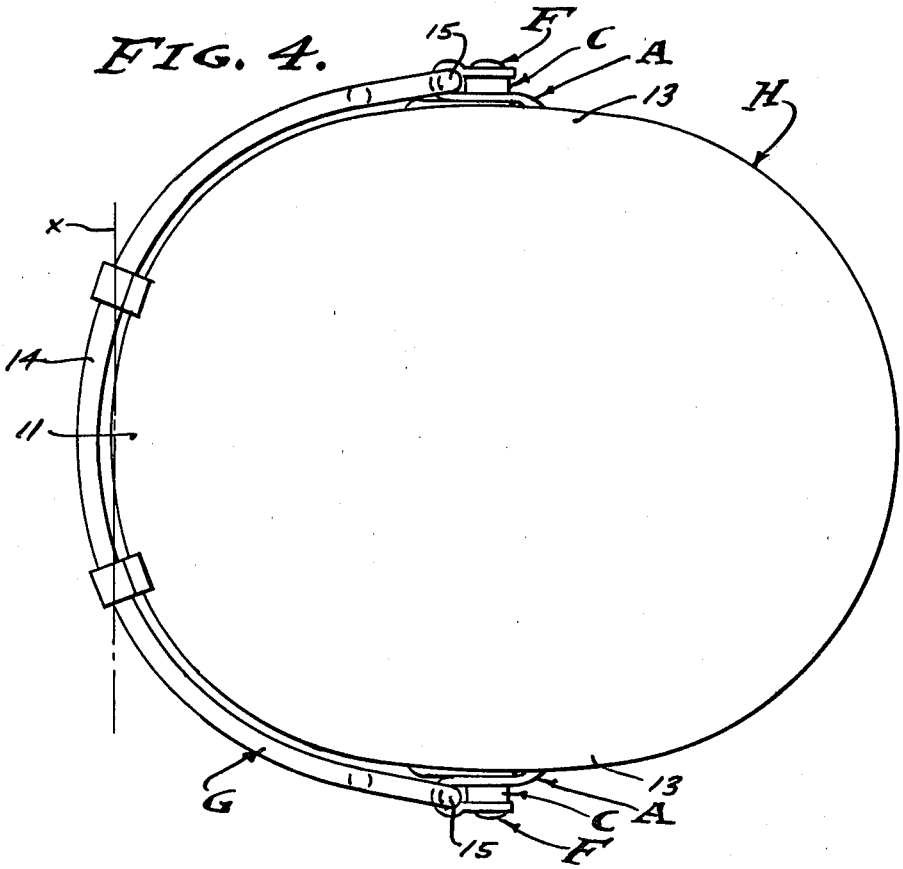
FIG. 4 is a plan view of the helmet and face guard installation by the anchor strap and shock damper and taken as indicated by line 4—4 on FIG. 1.

The anchor strap A as it is initially formed of pliable plastic having limited elasticity is shown in FIG. 2, and is comprised of said inner and outer loop portions 31 and 32 continuing one into the other. In order to be adapted to large and small helmets H and to face guards G of varied size and configurations, the elongated extent of the strap A in said initial form is excessive, and a feature thereof is the finished molded configuration at the inner end of said inner loop 31 for the reception of the fastener means F that secures said cooperative inner and outer loops and the shock damper C.

Figure 6:
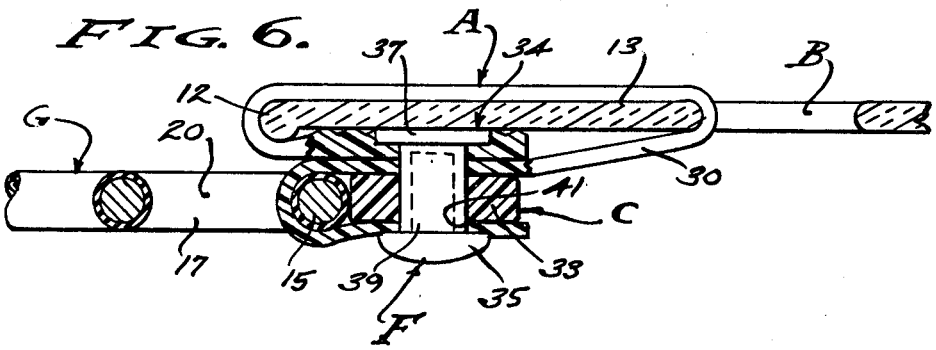

In accordance with this invention, the fastener means F involves a shear member that connects the oppositely extending loops on a single axis so that each loop can be tightly snubbed onto the ear portion 13 of the helmet H and onto the anchor bar 15 of the face guard G. In the preferred installation of the anchor strap A, the inner loop 31 extends over the forward edge 12 of the ear portion, then rearwardly and then outwardly through the ear hole B, and then forwardly to be engaged over the fastener means F as shown in FIG. 6, in which case the outer loop 32 extends forwardly and then rearwardly around the anchor bar 15 of the face guard G to be engaged over the fastener means F.

The shock damper C is disposed over the fastener means F and within the outer loop 32. It is to be understood that the aforesaid installation can be reversed with the inner and outer loops wrapped in a reverse manner, in which case the tension and compression modes of force application are correspondingly reversed. In practice however, it is preferred that the shock damper C act in the compression mode when the face guard G is forced toward the helmet H, and that the loops 31 and 32 act in the tension mode when the face guard G is forced away from the helmet H.

Figure 5:
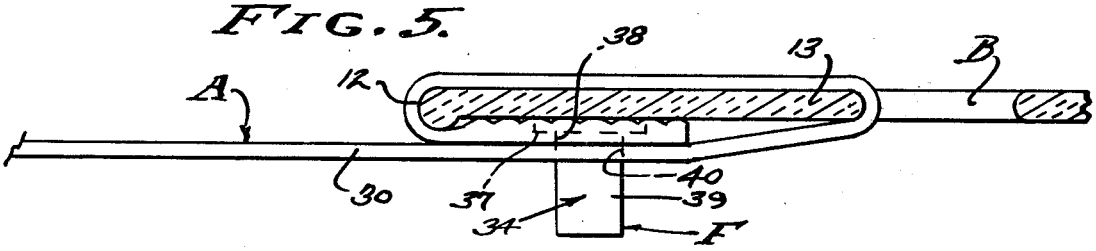
FIG. 5 is an enlarged sectional view showing partial assembly of the anchor strap to the helmet. And, FIG. 6 is an enlarged section view similar to FIG. 5 and taken as indicated by line 6—6 on FIG. 1 to show complete assembly of the helmet, face guard, anchor strap and shock damper.

The fastener means F is of cylinder form as it projects through the strap A, and it is preferably a tubular screw fastener known commercially as a tubular nut or T-nut 34 secured by a round headed screw 35, in this instance. The inner end and inside of the anchor strap A is recessed at 36 to accommodate the flat polygonal configuration of the T-nut head 37, so that it is retained axially and is prevented from turning. A close fitting opening 38 passes the cylindrical body of the tubular nut, so that the nut head 37 is backed by the helmet exterior and so that the cylinder body 39 of the nut projects for the reception of the overlying leg of the loop portion 31. The tight and/or snug securement of the inner loop 31 is illustrated in FIG. 5, the inner loop portion of the strap being wrapped tightly through the ear portion 13 as above described, the fastener position being marked in a suitable manner and a hole 40 punched therethrough as by means of a manually operable tool in the form of a punch-pliers (not shown). The hole 40 is then engaged over the cylinder body 39, as shown, and the flexible washer 33 of the shock damper C engaged thereover (see FIG. 6). The anchor strap A and shock damper C assembly is now prepared and the excess length of body 30 trimmed, for anchored reception of the face guard G, as next described.

The anchor strap A is applied tightly onto the helmet H so as to have substantial frictional engagement therewith, and to this end the inner end portion of the inner loop 31 is toothed so as to present a tread 50 engageable against the exterior surface of the ear portion 13 of the helmet. The tread 50 embraces the recess 36 that holds the tubular nut head 37, the tread 50 and head 37 being engageable against a common surface of the helmet ear portion 13.

The tight and/or snug securement of the outer loop 32 is illustrated in FIG. 6, the outer loop portion of the strap being wrapped tightly around the anchor bar 15 (at each side installation) as above described, the fastener position being marked in a suitable manner and a hole 41 punched therethrough as by means of a manually operable tool in the form of a punch-pliers the same as above (not shown). The hole 41 is then engaged over the cylinder body 39 and against the washer 33 so that the ends of the outer loop 32 are spaced substantially the same distance as the diameter of the anchor bar 15. The screw 35 is then applied to complete the assembled installation by engaging the inner face of the screw head with the top face of the tubular nut body and thereby limiting the compression applied to the lamination of overlapping portions of anchor strap A and the shock damper C.

From the foregoing it will be understood how the anchor strap A acts in the tension mode when installed as shown, or reversely; and how the shock damper C acts in the compression mode when installed as shown, or reversely. It is preferred that the shock damper C be installed as shown in order to provide a positioning stop which is elastically compressible to absorb shear impact loads, being reliably attached to the elastic anchor strap A which also yields under impact. It is preferred that the anchor strap A be installed as shown in order to provide a yielding member which is elastically extensible to absorb severe impact loads, being reliably coupled between the opposed heads of the fastener means F that limits the compression of the laminated assembly. The tread 50 provided on the inside of the inner loop 32 resists shifting of the anchorage, and flexibility of the anchor strap A provides for deformations caused by impacts and without adverse effect upon the helmet H or upon the face guard G attached thereto. Therefore, the resilience inherent in the helmet and face guard is utilized to the fullest extent without destroying the same or the said anchor strap A, even under severe working conditions. In the event of injury to the player which requires access to his face, then it is an easy matter to cut the anchor strap A and swing the face guard G from the helmet H. The complexity and cost of materials is minimal in light of the advantages and functions performed.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. Shock damping anchor straps for a face guard mounted on a transverse horizontal axis to a brow portion of a protective helmet, the face guard having a mounting bar rotatably mounted to the helmet on said axis and extending rearward at opposite sides of the helmet, and the face guard having opposite side anchor bars depending from the mounting bar at the front edges of opposite side ear portions of the helmet, there being an ear hole through each side ear portion of the helmet, and each anchor strap including a flexible body with inner and outer loop portions continuing one into the other from one end provided with a hole therethrough and to a terminal end, the hole at said one end being engaged over a fastener means and the inner loop portion formed into an inner loop wrapped around the front edge of the ear portion and passing through the ear hole of the helmet and secured by a second hole therethrough engaged over the fastener means, and the outer loop portion formed into an outer loop wrapped over the anchor bar and the said terminal end secured by a third hole therethrough engaged over and held by said fastener means.

2. The shock damping anchor strap for a face guard mounted to a helmet as set forth in claim 1, wherein the fastener means comprises a tubular nut engaged through the first mentioned hole at said one end of the anchor strap body and projecting outwardly from the ear portion of the helmet to engage through overlying loop portions.

3. The shock damping anchor strap for a face guard mounted to a helmet as set forth in claim 1, wherein the fastener means comprises a tubular nut engaged through the first mentioned hole at said one end of the anchor strap body and projecting outwardly from the ear portion of the helmet to engage through overlying loop portions, and a screw threaded into said tubular nut with a head engaged therewith and compressing the overlying loop portions in lapped engagement.

4. The shock damping anchor strap for a face guard mounted to a helmet as set forth in claim 1, wherein the fastener means comprises a tubular nut with a head recessed into said one end of the anchor strap body and with a cylindrical body projecting through the first mentioned hole therethrough and projecting outwardly from the ear portion of the helmet to engage through overlying loop portions.

5. The shock damping anchor strap for a face guard mounted to a helmet as set forth in claim 1, wherein the fastener means comprises a tubular nut with a head recessed into said one end of the anchor strap body and with a cylindrical body projecting through the first mentioned hole therethrough and projecting outwardly from the ear portion of the helmet to engage through overlying loop portions, and a screw threaded into said tubular nut with a head engaged therewith and compressing the overlying loop portions in lapped engagement.

6. The shock damping anchor strap for a face guard mounted to a helmet as set forth in claim 1, wherein a shock damper comprised of a compressible washer is engaged over the fastener means overlying the inner loop and adjacent the anchor bar to form a shock absorbing stop positioning the face guard.

7. The shock damping anchor strap for a face guard mounted to a helmet as set forth in claim 1, wherein the fastener means comprises a tubular nut engaged through the first mentioned hole at said one end of the anchor strap body and projecting outwardly from the ear portion of the helmet to engage through overlying loop portions, and wherein a shock damper comprised of a compressible washer is engaged over the fastener means overlying the inner loop and adjacent the anchor bar to form a shock absorbing stop positioning the face guard.

8. The shock damping anchor strap for a face guard mounted to a helmet as set forth in claim 1, wherein the fastener means comprises a tubular nut engaged through the first mentioned hole at said one end of the anchor strap body and projecting outwardly from the ear portion of the helmet to engage through overlying loop portions, and a screw threaded into said tubular nut with a head engaged therewith and compressing the overlying loop portions in lapped engagement, and wherein a shock damper comprised of a compressible washer is engaged over the fastener means overlying the inner loop and adjacent the anchor bar to form a shock absorbing stop positioning the face guard.

9. The shock damping anchor strap for a face guard mounted to a helmet as set forth in claim 1, wherein the fastener means comprises a tubular nut with a head recessed into said one end of the anchor strap body and with a cylindrical body projecting through the first mentioned hole therethrough and projecting outwardly from the ear portion of the helmet to engage through overlying loop portions, and wherein a shock damper comprised of a compressible washer is engaged over the fastener means overlying the inner loop and adjacent the anchor bar to form a shock absorbing stop positioning the face guard.

10. The shock damping anchor strap for a face guard mounted to a helmet as set forth in any one of claims 1 through 9, wherein the flexible body of the anchor strap is made of an elastic material.

11. The shock damping anchor strap for a face guard mounted to a helmet as set forth in any one of claims 1 through 9, wherein the flexible body of the anchor strap is made of polyurethane.

12. The shock damping anchor strap for a face guard mounted to a helmet as set forth in any one of claims 6, 7, 8 or 9, wherein the compressible washer of the shock damper is made of an elastic material.

13. The shock damping anchor strap for a face guard mounted to a helmet as set forth in any one of claims 6, 7, 8 or 9, wherein the compressible washer of the shock damper is made of polyurethane.

* * * * *